US005113179A

United States Patent [19]

Scott-Jackson et al.

[11] Patent Number: 5,113,179

[45] Date of Patent: May 12, 1992

[54] SWITCH JOYSTICK

[75] Inventors: Dennis Scott-Jackson; Harry Skibbe, both of Burnaby, Canada

[73] Assignee: Advanced Gravis Computer Technology Ltd., Burnaby, Canada

[21] Appl. No.: 494,479

[22] Filed: Mar. 16, 1990

[51] Int. Cl.[5] ..... G09G 3/02

[52] U.S. Cl. ..... 340/709; 74/471 X Y; 200/6 A

[58] Field of Search ..... 340/709; 200/6 A, 17 R; 74/471 XY

[56] References Cited

U.S. PATENT DOCUMENTS

| | | | |
|---|---|---|---|
| 4,590,339 | 5/1986 | Scott-Jackson et al. | 74/471 XY |
| 4,639,668 | 1/1987 | Petit et al. | 340/709 |
| 4,825,157 | 4/1989 | Mikan | 340/709 |

*Primary Examiner*—Jeffery A. Brier
*Assistant Examiner*—Regina Liang
*Attorney, Agent, or Firm*—Shlesinger, Arkwright & Garvey.

[57] ABSTRACT

A switch joystick including a lever, a switch coupled to the lever and operative in response to deflection of the lever by a selectable amount from a neutral position along a predetermined coordinate axis, and means for adjusting the amount of deflection necessary to operate the switch.

13 Claims, 3 Drawing Sheets

PRIOR ART

SWITCH JOYSTICK

BACKGROUND

The present invention relates to a type of joystick which provides on-off signals to a computer to control various game features.

Switch joysticks conventionally have four separate switches to switch when a joystick lever is deflected in one of two directions along each axis of a two dimensional coordinate system. When a switch is actuated it pulls a given line in the computer from a normally high 5 volt value down to ground, thus providing an input value to the computer. For some video games a large deflection is acceptable, particularly for games requiring only a beginner's skill level. However, for other games, such as a high speed car ride down a highway requiring interaction with other cars, only a small deflection is desirable so that a rapid response can be obtained. In addition, a more rapid return to a neutral position is helpful in such situations in order to speed up the response. Unfortunately, no known switch joysticks provide such features.

Accordingly, it is an object of the invention to provide an improved switch joystick. It is a further object of the invention to provide a switch joystick in which the lever deflection necessary to actuate corresponding switches is adjustable. It is yet another object of the invention to provide a switch joystick in which the biasing force on the lever which tends to return it to a neutral position is increased as the deflection necessary to actuate the switches is reduced.

SUMMARY OF THE INVENTION

According to the invention there is provided a switch joystick which includes a lever, a first switch coupled to said lever and operative in response to deflection of said lever by a selectable amount from a neutral position along a predetermined coordinate axis, and means for adjusting the amount of deflection necessary to operate the switch.

The lever may be biased towards the neutral position. Tensioning means may be included to increase or decrease the biasing force as the deflection amount necessary to actuate the switches is decreased or increased, respectively.

The joystick may include a second switch coupled to the lever and operative in response to deflection of the lever by a selectable amount from a neutral position along a direction opposite to that for operation of said first switch.

Tensioning means may be used for increasing or decreasing the biasing force as the deflection amount of the lever necessary to actuate the first and second switches is decreased or increased.

The lever means may be pivotal, the switch means is a switch, and the switch coupling means is a frame engaging a distal end of the lever and movable in response to deflection of the lever along an axis parallel to the direction of movement of the frame.

The switch means includes two cams coupled to respective ones of the frame elements and each cam is rotatable in response to movement of a corresponding one of the frame elements. A wiper is coupled to each of the cams with each wiper having two contacts for contacting conductive pads on a circuit board. A circuit board having a plurality of electrically conductive pads is mounted so that selected ones of the pads are contacted by the wiper. Switch point adjustment means adjust the angle through which the wiper must turn to contact one of the pads in order to connect a ground signal to one of two output pads.

One contact of one of said wipers contacts one of a pair of spaced apart output pads on the circuit board as the wiper is rotated away from a center position. A pair of output pads is electrically couplable to electrical lines leading to a computer, another of said contacts contacting in succession, as said wiper is rotated from the center position in a selected direction, a plurality of electrically conductive switch pads on the circuit board located on one side of center, and tension switch means for grounding each of said switch pads, in turn, from a central pad or pads to pads located in succession outwardly of the central position so as to change the switch point of said joystick.

The biasing means may be a spring contacting each end of each of the frame elements and the biasing adjustment means includes a notched wheel rotatable so as to move the springs and thereby adjust their biasing force, and said tension switch means is a tension frame member coupled to one of said springs so as to move as the length of said spring is adjusted, and wiper contact means coupled to said frame member and contacting electrical pads on said circuit board so as to connect selected one of said pads depending on the position of said tension frame member.

The circuit board includes a ground pad contacting one wiper contact throughout its rotation and a pair of spaced apart contacts whose adjacent edges define a V shape, and said switch point adjustment means includes means for moving said pair of pads away from or towards said ground pad so as to vary the spacing between said pads and the deflection of said wiper required to contact either of said pads.

BRIEF DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
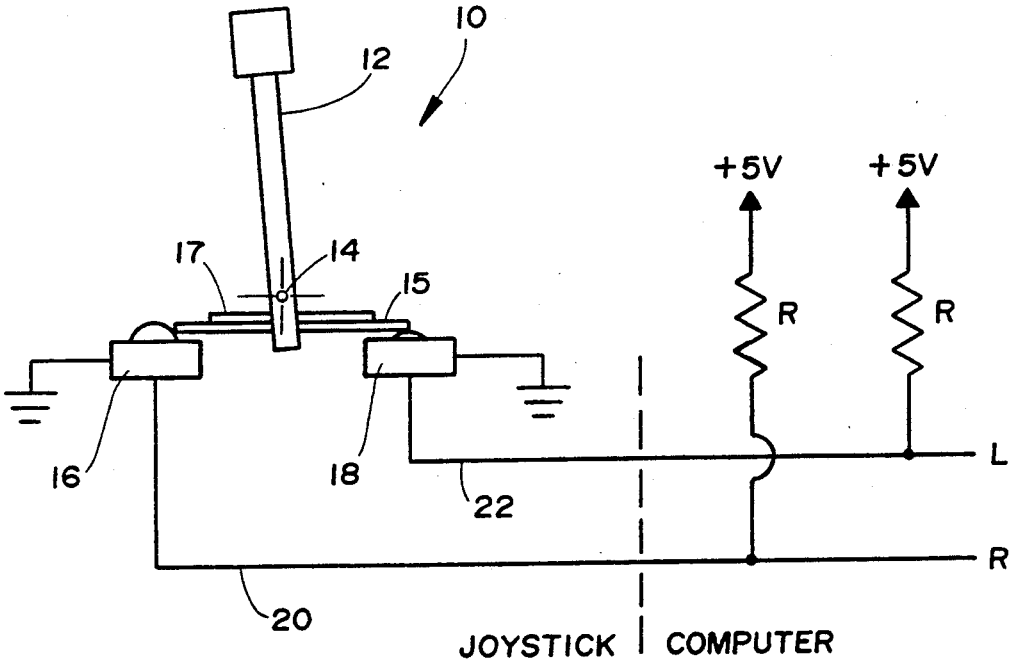
FIG. 1 is a schematic diagram of a common switch stick.

Referring to FIG. 1 there is shown a known switch stick device 10 in which a lever 12 pivotal about an axis 14 in any direction engages gimbal plates 15 and 17 which are movable in each of two orthogonal directions. A pair of microswitches 16 and 18 are located at either end of plate 15 such that in a neutral position plate 15 engages neither of switches 16 and 18. However, pivoting of lever 12 through a preset angle causes plate 15 to move and depress one of the two microswitches 16 and 18. Pivoting in an opposite direction actuates the other of the two microswitches 16 and 18.

Similarly, movement of lever 12 in an orthogonal direction causes plate 17 to move and actuate two other microswitches (not shown) in a similar way. Lines 20 and 22 are grounded when microswitches 16 and 18 are actuated, respectively, pulling corresponding associated "left" and "right" or "up" and "down" lines in a computer down from a normally 5 volt bias level to ground. Such ground signals are utilized by computer software to cause desired operation of a video game.

A limitation of such a device occurs as a player's skill level changes. Generally, games involving higher levels of skill require faster switching. In such cases it is desirable to have smaller deflections of the lever cause switch actuation. Conventional switch sticks do not provide such a facility. Additionally, levers are usually biased to return to a neutral position. Faster switching desirably employs stronger biasing forces and conventional switch sticks do not provide for such adjustment.

Figure 2:
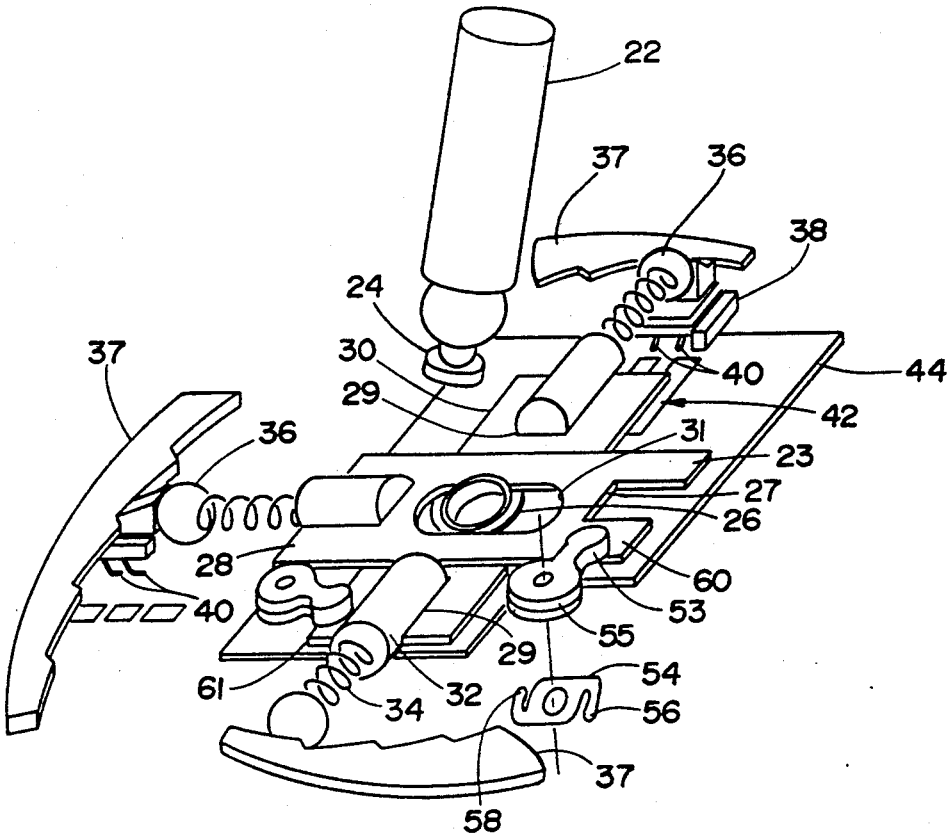
FIG. 2 is a perspective partial view of a switch stick in accordance with the present invention.

Referring to FIG. 2 there is shown in perspective a partial view of a switch stick in accordance with the present invention. In this case a pair of gimbal plates 28 and 30 are slidable in mutually orthogonal directions. Each of plates 28 and 30 has a pair of rectangular notches 27 and 29 formed in opposite ends. Cylinders 32 slide freely within notches 29 and in notches 27 abutting the ends of associated ones of notches 27 and 29. Coil springs 34 fit in the cylinders 32 and contact bearing balls 36. The bearing balls 36 in turn contact the notched inner periphery of a tension wheel 37. Rotation of tension wheel 37 for two orthogonally disposed bearing balls 36 either increases or decreases the extension of coil springs 34 and hence adjusts the biasing force on the associated gimbal plates 28 and 30. Elongated slots 31 are formed centrally in each gimbal plate 28 and 30. A lipped bushing 26 slidably engages each slot 31. A distal end 24 of a lever 22 engages the bushing 26 which, in turn, causes plates 28 and 30 to move in response to deflection of the lever 22.

Sliding frames 38 engage the other two orthogonally disposed bearing balls 36 and move with a change in tension on springs 34. A copper wiper 41 with wiper feet 40 is fitted to the underside of frame 38 and contacts elongated copper bands 42, 43, 45 or 47 on a circuit board 44 located beneath plates 28 and 30.

In the side of each gimbal plate 28 and 30 there is formed a U-shaped notch 60 and 61. Cams 55 and 57 have cylindrical extensions 53 and 59 which engage notches 60 and 61, respectively. Movement of gimbal plate 28 causes cam 55 to rotate while movement of gimbal plate 30 causes cam 57 to rotate. To the underside of each cam there is fitted a wiper 54 as shown in an exploded view in FIG. 2 in which a portion of circuit board 44 is broken away. Wiper 54 has two diametrically opposite contact arms 56 and 58 which contact a surface of circuit board 44. A large frame structure which is located between the gimbal plates 28 and 30 and the circuit board and to which cams 55 and 57 and gimbal plates 28 and 30 are mounted has been omitted for clarity.

Figure 3:
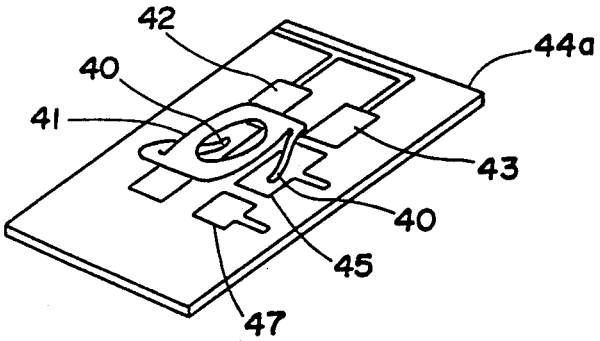
FIG. 3 is a partial view of a wiper and a portion of a circuit board over which the wiper moves.
Figure 4:
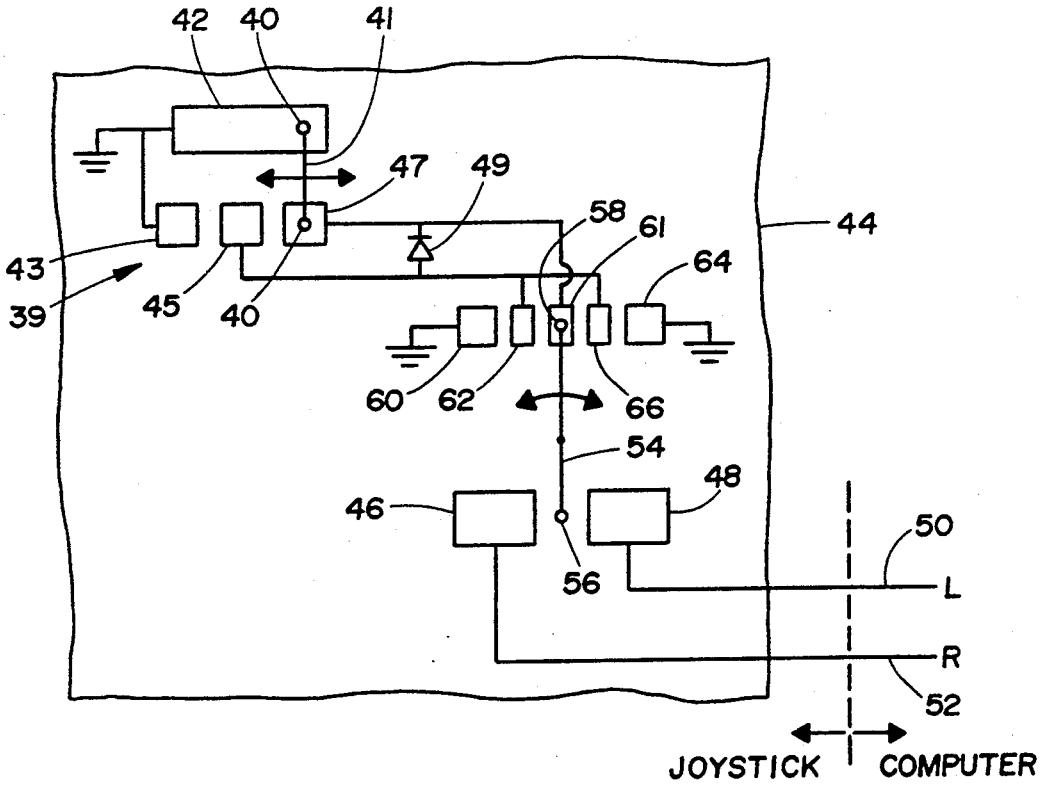
FIG. 4 is a plan view of a portion of the circuit board showing one pad area for use in adjusting switch point as a function of biasing force.

Referring to FIG. 3 a portion of the circuit board 44 and copper pads 42, 43, 45 and 47 are shown. Wiper arms 40 contact respective pads 42, 43, 45 or 47. One foot of wiper feet 40 is split into three electrically separated pads 43, 45 and 47 as seen in FIG. 4.

A plurality of pads are arranged on circuit board 44 with two pads 46 and 48 along one row and five pads 60,61, 62, 64 and 66 along another row. A copper wiper 54 identical to wiper 41 is positioned so that contact 56 thereof contacts pads 46 and 48 an contact 58 contacts the other five pads 60, 61, 62, 64 and 66 as wiper 54 is rotated.

Pads 46 and 48 are electrically connected to "left" and "right" lines 52 and 50, respectively, in a computer (not shown). The spacing between pads is such that when wiper contact 56 is between pads 46 and 48, contact 58 is on centrally located pad 61. With the tension wheel 37 set for a high biasing force wiper 41 will contact and ground pad 47 and hence, central pad 61. As wiper 54 is rotated clockwise contact 56 contacts and grounds pad 46. If the setting of the tension wheel 37 is such that wiper 41 contacts pad 45, pad 66 is connected to ground and a further rotation of wiper 54 until contact 58 contacts pad 66 before pad 46 is grounded. Grounding of pad 46 causes "right" line 52 to be pulled low. As wiper 54 is further rotated contact 58 will contact pad 64, again grounding pad 46 and line 52. Thus, for a tension wheel 37 setting of low bias force such that pad 43 is contacted, contact with pad 64 must be made before grounding of pad 46 occurs. For an intermediate setting of tension wheel 37 such that pad 45 is grounded rotation of wiper 54 must be sufficient for contact 58 to contact pad 66. For a setting of tension wheel 37 providing for a high bias force, pads 47 and 61 are grounded so that only a small amount of rotation of wiper 54 is required to ground pad 46. .

Similarly, for rotation of wiper 54 counterclockwise pads 61, 62 and 60 are contacted in succession and electrically connected via wiper 54 to pad 48. The level of biasing force set by tension wheel 37 determines which of pads 61 and 62 are grounded as is the case for pads 61 and 66. Operation is identical to that for clockwise rotation of wiper 54.

It will be appreciated that the setting of the tension wheel 37 determines the deflection angle through which lever 22 must pivot before either lines 50 or 52 are pulled to ground. The present design provides for three different switch settings, namely, five degrees, ten degrees and 15 degrees from the neutral point. Different deflections for switching simply require different spacings of pads 46, 48, 60, 61, 62, 64 and 66. The latter pads are associated with cam 55. A second set of such pads 46, 48, 60, 61, 62, 64 and 66 is provided for cam 57 and has a wiper-pad assembly that operates identically to wiper 54.

Figure 5:
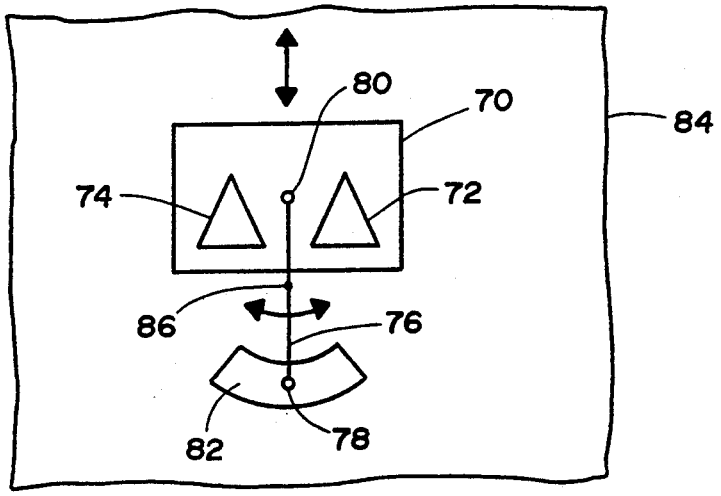
FIG. 5 is an alternative device for adjusting switch point as a function of tension wheel setting.

An alternative embodiment for use in changing the switch point with a change in biasing force is shown in FIG. 5 in which a wiper 76 has contact arms 78 and 80 which contact a surface of a circuit board 84 and a slidable board 70, respectively. Board 70 has two pads 72 and 74 separated by a V-shaped non-conducting region. Board 70 is movable in a linear direction shown in response to a change in setting of tension wheel as shown for FIG. 2 utilizing a frame 38 to move board 70. A pad 82 which is grounded, grounds either pad 72 or 74 at an angle of rotation of wiper 76, and hence deflection of lever 22 which depends on the position of board 70 relative to board 84. The system of FIG. 5 requires more moving parts than that of FIG. 4 but allows for a greater number of switch point settings.

Other variations, modifications and departures, lying within the spirit of the invention and scope as defined by the appended claims will be obvious to those skilled in the art.

We claim:

1. A switch joystick, comprising:

(a) a lever pivotal along at least one direction;

(b) a first switch coupled to said lever and actuated in response to deflection of said lever by a selectable amount from a neutral position along said at least one direction; and (c) means for adjusting the selectable amount of lever deflection in said at least one direction necessary to actuate said first switch.

2. A joystick according to claim 1, including a second switch coupled to said lever and actuated in response to deflection of said lever by a selectable amount from a neutral position along a direction orthogonal to that for actuation of said first switch.

3. A joystick according to claim 1, including biasing means for biasing said lever towards a neutral position and wherein said adjusting means includes tensioning means for increasing the biasing force for a given lever deflection from the neutral position and reducing the amount of deflection from the neutral position required in order to reach a switch point at which said first switch is activated.

4. A switch joystick, comprising:

(a) lever means movable in at least one dimension;

(b) switch means for switching an electrical signal on an output terminal on and off;

(c) switch coupling means for coupling said switch means to said lever means such that in response to movement of said lever means by a selected amount said switch means turns on and off said electrical signal; and (d) adjustment means for changing said switch coupling means so the selected amount of movement of said lever means to switch said switch means changes.

5. A joystick according to claim 4, including biasing means for biasing said lever means towards a neutral position and wherein said adjustment means also changes said biasing means so as to increase the biasing force of said biasing means as the amount of movement of said lever means to switch said switch means is reduced.

6. A joystick according to claim 4 or 5, wherein said lever means is a pivotal lever, said switch means is a switch, said switch coupling means is a frame engaging a distal end of said lever and movable in response to deflection of said lever along an axis parallel to the direction of movement of said frame.

7. A switch joystick, comprising:

(a) lever means for generating movement in any direction in a two dimensional plane from a neutral point;

(b) a pair of frame elements coupled to said lever means and each moveable in one of two orthogonal directions in response to movement of said lever means;

(c) switch means coupled to each of said frame elements and actuated in response to movement of each of said frame elements by a preselected amount; and (d) switch point adjustment means for adjusting the amount of movement of said lever means from the neutral point required to actuate said switch means.

8. A joystick according to claim 7, including biasing means for biasing said lever means towards a neutral position and biasing adjustment means for changing the biasing force of said biasing means.

9. A joystick according to claim 7, wherein said switch point adjustment means and said biasing adjustment means are coupled together so that an increase in the amount of lever deflection required for switching is accompanied by a reduction in said biasing force for a given amount of deflection.

10. A joystick according to claim 7, wherein said switch means includes two cams coupled to respective ones of said frame elements and each cam being rotatable in response to movement of a corresponding one of said frame elements, a circuit board having a plurality of electrically conductive pads including a pair of output pads, a wiper coupled to each of said cams, each wiper having two contacts for contacting conductive pads on said circuit board, said pads being positioned so that selected ones of said pads are contacted by said wiper, switch point adjustment means for adjusting the angle through which said wiper must turn in order to contact one of said pads so as to connect a ground signal to said one output pad.

11. A joystick according to claim 10, wherein one contact of one of said wipers contacts one of said pair of spaced apart output pads on said circuit board as said wiper is rotated away from a center position, said pair of output pads being electrically couplable to electrical lines leading to a computer, another of said contacts contacting in succession as said wiper is rotated from the center position in a selected direction, a plurality of electrically conductive switch pads on said circuit board located on one side of center, and tension switch means for grounding each of said switch pads, in turn, from a central pad or pads to pads located in succession outwardly of the central position so as to change the switch point of said joystick.

12. A joystick according to claim 8 or 9, wherein said biasing means includes springs contacting respective opposite ends of said frame elements and said biasing adjustment means includes a notched wheel rotatable so as to move said springs and thereby adjust their biasing force, and said tension switch means includes tension frame members juxtaposed to said notched wheel and to associated ones of said springs so as to move as the length of an associated one of said springs is adjusted, and wiper contacts coupled to respective ones of said frame members and contacting electrical pads on respective ones of said circuit boards so as to connect selected one of said pads depending on the position of said tension frame member.

13. A joystick according to claim 10, wherein said circuit board includes a ground pad contacting one wiper contact throughout its rotation and a pair of spaced apart contacts whose adjacent edges define a V shape, and said switch point adjustment means includes means for moving said pair of pads away from or towards said ground pad so as to vary the spacing between said pads and the deflection of said wiper required to contact either of said pads.

* * * * *